US006414573B1

(12) United States Patent
Swineford et al.

(10) Patent No.: US 6,414,573 B1
(45) Date of Patent: Jul. 2, 2002

(54) STRIPLINE SIGNAL DISTRIBUTION SYSTEM FOR EXTREMELY HIGH FREQUENCY SIGNALS

(75) Inventors: Kevin D. Swineford, West Hills; John M. Saliba, La Palma, both of CA (US)

(73) Assignee: Hughes Electronics Corp., El Segundo, CA (US)

( * ) Notice: Subject to any disclaimer, the term of this patent is extended or adjusted under 35 U.S.C. 154(b) by 0 days.

(21) Appl. No.: 09/505,265

(22) Filed: Feb. 16, 2000

(51) Int. Cl.[7] ..... H01P 3/08
(52) U.S. Cl. ..... 333/238; 333/260
(58) Field of Search ..... 333/238, 246, 333/260

(56) References Cited

U.S. PATENT DOCUMENTS 3,218,584 A * 11/1965 Ayer ..... 333/246
4,556,265 A * 12/1985 Cunningham ..... 333/260 X
5,012,209 A * 4/1991 Lantagne et al. ..... 333/238 X
5,278,524 A * 1/1994 Mullen ..... 333/238 X
5,334,800 A * 8/1994 Kenney ..... 333/238 X
5,338,567 A * 8/1994 Kohm ..... 427/98
5,712,607 A * 1/1998 Dittmer et al. ..... 333/246 X
5,717,476 A * 2/1998 Kanezawa ..... 349/149
5,724,012 A * 3/1998 Teunisse ..... 333/238

* cited by examiner

*Primary Examiner*—Justin P. Bettendorf
(74) *Attorney, Agent, or Firm*—John R. Rafter; Terje Gudmestad

(57) ABSTRACT

A microwave stripline signal distribution system utilizes a central conductor that is supported on a substrate, which is itself captured and supported between two foam layers. External ground plane shielding is provided on each side of the foam/central-conductor-substrate sandwich. The metallic central conductor is thin, as are the other structural elements, leading to a lightweight signal distribution system. The central conductor may be patterned to provide a large number of feeds. The approach allows: the inexpensive fabrication of lightweight signal distribution boards, whose inputs and outputs may be combined to provide single-channel or multi-channel combination or division of microwave signals. In a typical application, there is combination or division of microwave signals in an antenna involving hundreds of individual feed horns.

15 Claims, 5 Drawing Sheets

STRIPLINE SIGNAL DISTRIBUTION SYSTEM FOR EXTREMELY HIGH FREQUENCY SIGNALS

BACKGROUND OF THE INVENTION

This invention relates to microwave distribution systems, and, more particularly, to a stripline structure used in a microwave system.

Microwave energy is employed to transmit communications signals because of its high frequency and the consequent ability to convey a large amount of information, and because it may be amplified to high power levels. For example, extremely high frequency (EHF) energy in the 15–40 GHz (gigahertz) range is used in many communications applications. The communications signals conveyed through communications satellites are transmitted from an earth ground station through free space to the satellite in geosynchronous orbit. The signals are there amplified by an on-board amplifier and retransmitted through free space to another earth ground station.

When the microwave signals are being amplified and otherwise processed on board the satellite, they are conveyed in waveguides and/or on thin metallic substrates termed striplines. At some points in the distribution system, waveguides are too large in physical dimensions too heavy, and too complex to be practical. For example, microwave signals conveyed from and to the segmented antennas of the satellite must be combined when received and divided when transmitted. A waveguide system may be used for these purposes, but it is large, heavy, and complex. A stripline system is much smaller, lighter, cheaper, and less complex, but it exhibits a higher signal attenuation than the waveguide.

There is therefore a tradeoff between the two approaches. The stripline system would be more attractive in applications such as antenna systems if it could be built to be lighter and less costly than possible with presently available approaches. Accordingly, there is a need for a better approach to microwave stripline structures which are particularly suited for packing a large number of stripline conductors into a small space. The present invention fulfills this need, and further provides related advantages.

SUMMARY OF THE INVENTION

The present invention provides a stripline structure suitable for conducting microwave signals. The stripline structure is compact and extremely light in weight. It is constructed from available, space-qualified materials, and may be readily fabricated. Its radio frequency attenuation is acceptable, while maintaining the mechanical rigidity for use in spacecraft. The stripline structure may be sized to be suitable for use with a wide range of microwave frequencies, including the 15–40 Gigahertz extremely high frequency range that is desirable for communications satellites. The stripline structure is designed for efficient scale-up to a multichannel form that accommodates a large number of signals on individual stripline conductors. The stripline structure is thus particularly useful for combiner/divider applications such as those used to carry signals from and to microwave antennas.

In accordance with the invention, a microwave stripline structure includes a first-layer conductor structure comprising a nonmetallic central conductor substrate having a first side and a second side,band a first ground plane layer spaced apart from the first side of the central conductor substrate. The first ground plane layer includes a first ground plane substrate, preferably comprising a nonmetallic material, and a first metallic layer structure contacting at least one side of the first ground plane substrate. The stripline structure further includes a first foam layer disposed in contact with the first side of the central conductor substrate and with the first ground plane layer. The first foam layer optionally but preferably has a first channel therethrough with the first foam layer, the central conductor substrate, and the ground plane layer bounding the first channel. An elongated metallic central conductor is present on the first side of the central conductor substrate, within the first channel in the embodiments having the first channel.

The stripline structure further includes a second ground plane layer spaced apart from the second side of the central conductor substrate. The second ground plane layer includes a second ground plane substrate, preferably comprising a nonmetallic material, and a second metallic layer structure contacting at least one side of the second ground plane substrate. A second foam layer may be disposed in contact with the second side of the central conductor substrate and with the second ground plane layer. The second foam layer optionally but preferably has a second channel therethrough in registry with the first channel, with the second foam layer, the central conductor substrate, and the ground plane layer bounding the second channel. It is preferred that the central conductor substrate, the first ground plane layer, and the second ground plane layer are substantially planar and parallel to each other to a tolerance of within +/−0.001 inch.

In a form particularly suitable for a multichannel, stacked arrangement, a microwave stripline structure includes a first-layer conductor structure comprising a substantially planar nonmetallic central conductor substrate having a first side and a second side. The central conductor substrate preferably comprises a composite material of fibers embedded in a cured resin. There is a substantially planar first ground plane layer spaced apart from the first side of the central conductor substrate. The first ground plane layer includes a first ground plane substrate, preferably comprising a nonmetallic material, and a first metallic layer structure on the first ground plane substrate. The first metallic layer structure includes a first metallic inner layer facing the central conductor substrate and a first metallic outer layer disposed remotely from the central conductor substrate. There is a substantially planar first foam layer in contact with the first side of the central conductor substrate and with the first ground plane layer. The first foam layer has a first channel therethrough with the first foam layer, the central conductor substrate, and the ground plane layer bounding the first channel. An elongated metallic central conductor is positioned on the first side of the central conductor substrate within the first channel. There is a substantially planar second ground plane layer spaced apart from the second side of the central conductor substrate. The second ground plane layer includes a second ground plane substrate, preferably comprising a nonmetallic ;material, and a second metallic layer structure on the second ground plane substrate. The second metallic layer structure includes a second metallic inner layer facing the central conductor substrate and a second metallic outer layer disposed remotely from the central conductor substrate. There is additionally a substantially planar second foam layer disposed in contact with the second side of the central conductor substrate and with the second ground plane layer. The second foam layer has a second channel therethrough, in registry with the first channel, with the second foam layer, the central conductor substrate, and the ground plane layer bounding the second channel. Optionally, a nonmetallic post may extend through the central conductor substrate, the first ground plane layer, the first foam layer, the second ground plane layer, and the second foam layer.

Stated alternatively, a microwave stripline structure includes a first-layer conductor structure having a first suspended stripline conductor comprising a planar nonmetallic central conductor substrate having a first side and a second side, an elongated metallic central conductor on a first side of the central conductor substrate, and two planar ground plane, layers. One ground plane layer is in facing-but-spaced apart relation to each side of the central conductor substrate. Each ground plane layer comprises a ground plane substrate, preferably made of a nonmetallic material, and a metallic layer structure contacting at least one side of the ground plane substrate. The stripline structure further includes two planar foam layers. Each foam layer contacts one side of the central conductor substrate and one of the ground plane layers. Each foam layer has a channel therethrough in registry with the channel of the other foam layer, with the elongated metallic central conductor lying within one of the channels. The respective foam layer, the central conductor substrate, and the respective ground plane layer bound each channel.

In any of these embodiments, the basic stripline structure may be readily expanded to a multichannel form. In one approach involving an in-plane expansion, the first-layer conductor structure has at least one additional stripline conductor, with each additional stripline conductor having a structure substantially identical to the first stripline conductor. In a second approach involving a parallel-plane expansion, a second-layer conductor structure is in facing relation to the first-layer conductor structure. The second-layer conductor structure has the same structure as the first-layer conductor structure.

Typically, the ground plane substrates in the various embodiments comprise a flexible absorber material having an electrical resistance of about that of free space (i.e., about 377 ohms). The ground plane substrates are each preferably a layer of semi-conductive, absorptive fibers. The central conductor substrate comprises a composite material of quartz fibers embedded in a cured cyanate ester resin. The foam layers comprise an electrically nonconductive, closed-cell foam such as polymethacrylimide foam.

A feature of the preferred form of the invention is that it contains no polytetrafluoroethylene (sometimes known as Teflon™) polymer. This material is difficult to bond and usually requires a housing to mechanically position it. Further, it has a tendency to cold flow in a space environment. The presently preferred approach uses no polytetrafluoroethylene.

The present approach provides a light weight, strong, readily manufactured stripline structure. The basic design may be expanded to a large number of applications using in-plane or parallel-plane arrangements. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
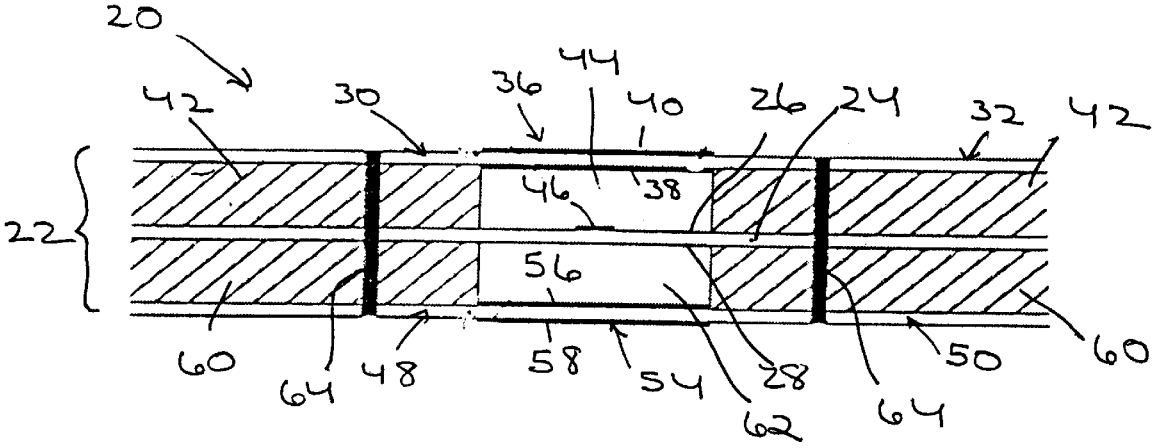
FIG. 1 is a schematic sectional view of a stripline structure according to the invention.

FIG. 1 depicts a stripline structure 20 according to a preferred embodiment of the invention. The stripline structure 20 includes a first-layer conductor structure 22, which comprises a nonmetallic central conductor substrate 24 having a first side 26 and a second side 28. The central conductor substrate 24 is preferably, but not necessarily, substantially planar. The stripline structure 20 further includes a first ground plane layer 30, which is preferably but not necessarily planar, spaced apart from the first side 26 of the central conductor substrate 24. The first ground plane layer 30 includes a first ground plane substrate 32, preferably made of a nonmetallic material, and a first metallic layer structure 36 on the first ground plane substrate 32. The first metallic layer structure 36 includes a first metallic inner layer 38 facing the central conductor substrate 24, and, optionally, a first metallic outer layer 40 disposed remotely from the central conductor substrate 24.

A first foam layer 42, which is preferably but not necessarily planar, is disposed in contact with and between the first side 26 of the central conductor substrate 24 and the first ground plane layer 30. The first foam layer 42 preferably has a first channel 44 therethrough. The first foam layer 42, the central conductor substrate 24, and the first ground plane layer 30 bound the first channel 44 and form its sides, top, and bottom.

An elongated metallic central conductor 46 is disposed on the first side 26 of the central conductor substrate 24 within the first channel 44.

A second ground plane layer 48, which is preferably but not necessarily planar, is spaced apart from the second side 28 of the central conductor substrate 24. The second ground plane layer 48 includes a second ground plane substrate 50, preferably made of a nonmetallic material, and a second metallic layer structure 54 on the second ground plane substrate 50. The second metallic layer structure includes a second metallic inner layer 56 facing the central conductor substrate 24 and, optionally, a second metallic outer layer 58 disposed remotely from the central conductor substrate 24.

A second foam layer 60, which is preferably but not necessarily planar, is disposed in contact with and between the second side 28 of the central conductor substrate 24 and with the second ground plane layer 48. The second foam layer 60 preferably has a second channel 62 therethrough, in registry with the first channel 44. (As used herein, the term "registry" means that elements of structure are spatially aligned with each other, vertically in the view of FIG. 1.) The second foam layer 60, the central conductor substrate 24, and the second ground plane layer 48 bound the second channel 62 and form its sides, top, and bottom.

Thus, in this embodiment, the central conductor substrate 24 is sandwiched and captured between the two foam layers 42 and 60, which are in turn sandwiched and captured between the ground plane layers 30 and 48. The ground plane layers 30 and 48, with their respective metallic layer structures 36 and 54, together with the foam layers 42 and 60, define the pair of hollow channels 44 and 62 in which the metallic central conductor 46 is suspended on the central conductor substrate 24. The presence of the hollow channels 44 and 62 minimizes the attenuation of the microwave signal propagated on the metallic central conductor 46, as there is no structure contacting the metallic central conductor 46 which would load it and change its electrical properties, and there is no structural foam present in the vicinity of the primary electrical fields emanating from the central conductor 46. The metallic layer structures 36 and 54, together with the foam layers 42 and 60, confine the primary electrical fields to the unloaded, material-free zones or channels 44 and 62.

Figure 8:
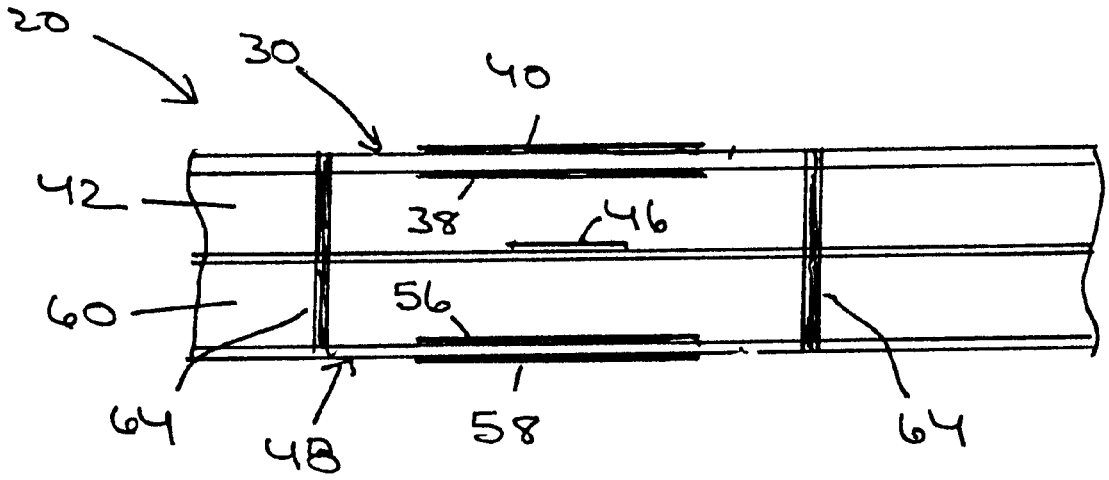
FIG. 8 is a schematic sectional view of another embodiment of the stripline structure according to the invention.

The channels 44 and 62 need not be present, and the metallic central conductor 46 may be sandwiched directly between the foam layers 42 and 60. This embodiment is illustrated in FIG. 8. This embodiment is operable but is not preferred, because the portions of the foam layers 42 and 60 adjacent to the metallic central conductor 46 add about 0.25 dB per foot of loss to the stripline structure at a frequency of about 20 GHz.

Optionally, nonmetallic posts 64 may extend through the central conductor substrate 24, the first ground plane layer 30, the first foam layer 42, the second ground plane layer 48, and the second foam layer 60. These posts, which are positioned on each side of the channels 44 and 62, enhance the isolation between horizontally (laterally) adjacent and vertically stacked adjacent metallic central conductors 46 as will be discussed in relation to FIGS. 2 and 3.

Any operable materials of construction and dimensions may be used in the construction of the stripline structure 20. The preferred materials of construction and dimensions were selected for the construction of a stripline structure 20 for use in a communications satellite with propagated microwave signals in the 20–30 gigahertz range. These materials and dimensions were selected for operability as well as for considerations of cost, fabricability, and both short-term and long-term stability in a space environment. Additionally, the materials desirably meet NASA Specification SP-R-0022A and are therefore qualified for use in a spacecraft application. This specification requires that the total mass loss (TML) not exceed 1.0 percent and the proportion of collected volatile condensable material (CVCM) be not more than 0.10 percent, when tested by the method set forth in ASTM E595. This testing process is discussed in W. Campbell, Jr. and R. Marriott, *Outgassing Data for Selected Spacecraft Materials,* NASA Reference Publication 1124 Revised (1987), pages 1–3.

The central conductor substrate 24 is an electrical nonconductor that has sufficient mechanical strength to support the metallic central conductor 46, is light in weight, and is stable. The preferred material for use in the central conductor substrate 24 is a composite material of quartz fibers embedded in a cyanate ester resin. Other types of electrically nonconductive fibers and resins may be used as well. The central conductor substrate 24 is preferably from about 0.004 to about 0.006 inches thick.

The metallic central conductor 46 is a thin layer of a metal such as copper or aluminum. It may be applied onto the central conductor substrate 24 by any operable technique, such as screen printing, vapor deposition and etching, bonding, or the like. The metallic central conductor 46 is preferably from about 0.0007 to about 0.0014 inches thick.

The foam layers 42 and 60 are preferably made of a material that is light in weight and electrically invisible, most preferably a closed-cell, nonmetallic structural foam. A preferred foam material is a polymethacrylimide closed-cell foam available commercially as Rohacell foam from Richmond Aircraft Products. The foam layers 42 and 60 are preferably about 0.025±/−0.001 inch thick. The first-layer stripline conductor structure 22 is therefore about 0.050 inch thick. The foam material may optionally be doped to have a resistivity of about 377 ohms, the resistivity of free space, to aid in the control of spurious energy.

The ground plane substrates 32 and 50 are each preferably a free space absorber that attenuates spurious energy. The preferred material is an open-weave of carbon fibers sometimes termed "space cloth". This material is light in weight, aids in achieving inter-channel isolation, and supports the metallic layer structures 36 and 54. The ground plane substrates 32 and 50 are each preferably from about 0.004 to about 0.006 inches thick.

The metallic layer structures 36 and 54 include thin metallizations that form the layers 38, 40, 56, and 58. The layers 38, 40, 56, and 58 may be any electrically conductive metal, such as copper, silver, gold, and the like. The layers 38, 40, 56, and 58 are typically from about 0.0007 to about 0.0014 inches thick, and are deposited by plating or other operable deposition approach.

The support posts 64 are preferably made of carbon fiber composite material, and are about 0.10 inch in diameter.

Figure 2:
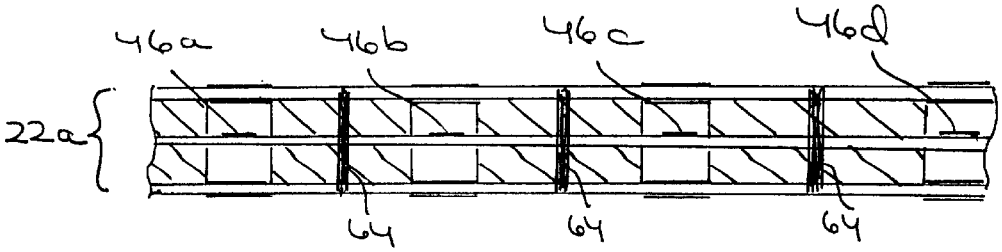
FIG. 2 is a schematic sectional view of a stripline structure having multiple striplines in a single plane.
Figure 3:
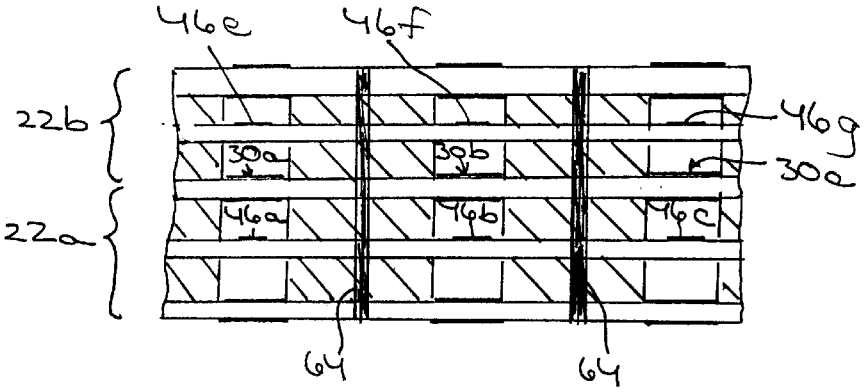
FIG. 3 is a schematic sectional view of a stripline structure having multiple striplines in parallel planes.

The elements of the structure are joined by any operable approach. The metallic layers 38, 40, 46, 56, and 68 are typically deposited upon their respective substrates as discussed earlier. The layers 22, 30, 42, 48, and 60 may be collated and joined as they are collated using any operable adhesive. Vertically stacked stripline structures, such as shown in FIGS. 2 and 3, may also be joined by adhesive. Other approaches may be used to reduce the adhesive weight that is used. For example, the layers 22, 30, 42, 48, and 60 may be joined together by stitching (sewing) using an appropriate thread such as a polymeric thread and a surface washer. In yet another approach, the layers may be first appropriately punched and then assembled onto the posts 64, which thereby serve as guides for the assembly and alignment of the layers. Stitches or other appropriate caps are added to the ends of the posts 64 to hold the assembled layers in place. The posts 64 thereby serve both the electrical function and the structural function.

The stripline structure 20 desirably does not contain any polytetrafluoroethylene, a material often termed "Teflon™" polymer Polytetrafluoroethylene is widely used in other stripline structures, but it has the disadvantages that it is difficult to bond and that it tends to cold flow in a space environment. An extra housing is therefore required to confine the polytetrafluoroethylene, adding to the weight; of the structure. The preferred present approach avoids the use of polytetrafluoroethylene, reducing manufacturing difficulties and improving the life expectancy and reliability of the stripline structure.

The first-layer conductor structure 22 may be handled for assembly into larger structures, and processed by many conventional techniques such as drilling, fastening, cutting, and finishing. It is about, ⅓ the weight of conventional structures that accomplish the same function.

The first-layer conductor structure 22 of FIG. 1 carries a single signal on a single metallic central conductor 46.

However, the layered approach depicted in FIG. 1 allows the construction of more-complex structures capable of carrying multiple signals. One approach is depicted in FIG. 2, in which there are multiple metallic central conductors 46*a*, 46*b*, 46*c*, and 46*d* in a single layer conductor structure 22*a*. A number of the structures illustrated in FIG. 1 are thus arranged horizontally (laterally) in a side-by-side fashion within a single layer in this approach. Another approach is depicted in FIG. 3, in which there are multiple metallic central conductors 46*a*, 46*b*, and 46*c* in the first-layer conductor structure 22*a*, as in FIG. 2. Additionally, there are multiple metallic central conductors 46*e*, 46*f*, and 46*g* in a second-layer conductor structure 22*b*. The central conductors 46*e*, 46*f*, and 46*g* are arranged vertically in registry with the respective central conductors 46*a*, 46*b*, and 46*c* of the first-layer conductor structure 22*a*. The various conductors are shielded from each other by the respective first ground plane layers 30*a*, 30*b*, and 30*c*. The construction of the stripline structures of FIGS. 2 and 3 is otherwise as described in relation to FIG. 1, and that discussion is incorporated here.

Figure 4:
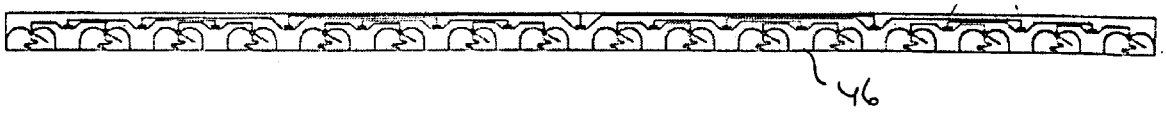
FIG. 4 is a plan view of the central conductor in one embodiment of the invention.

Any or all of the central conductors 46 may be etched or otherwise formed into complex shapes, when viewed in a plan view, as may be required for a specific conductor requirement. FIG. 4 illustrates one such form of the central conductor 46 used for signal distribution in an antenna system. This form of central conductor 46 allows the input of a signal on one conductor or set of conductors and output on another conductor or set of conductors. This form of central conductor may be provided as a compact, lightweight board structure, much like a planar circuit board, for distributing microwave signals as will be illustrated in relation to FIGS. 6–7.

Figure 5:
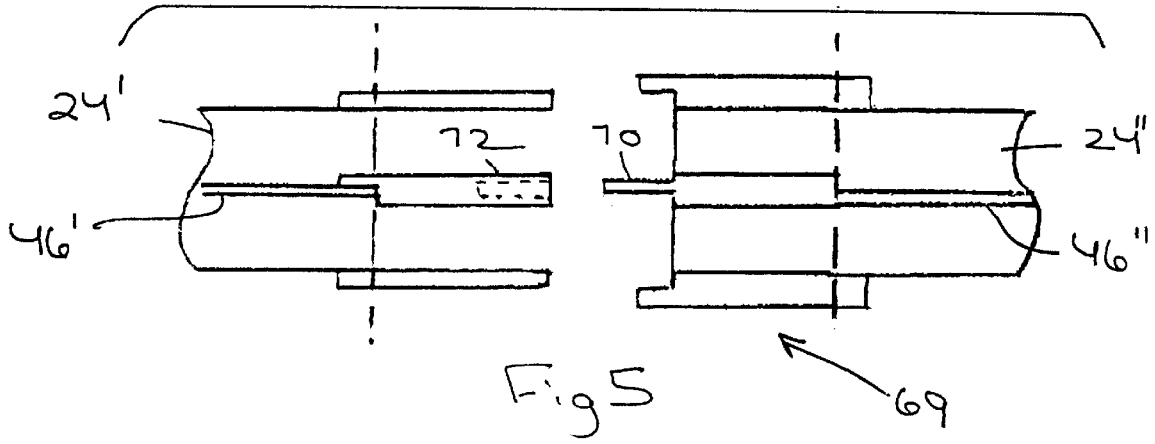
FIG. 5 is a schematic exploded plan view of a flat stripline/coaxial/coaxial/stripline connector.

The present approach provides for the mechanical interconnection of the stripline central conductors 46 using an interconnect structure 69, illustrated in FIG. 5. The metallic central conductors 46' and 46" are each provided with metallic wire-like extensions on their ends to permit their interconnection. These extensions, termed coaxial extensions, include a male extension 70 and a female extension 72 with a receptacle therein. The extensions 70 and 72 may be coaxially connected to each other. The embodiment of FIG. 5 provides for coplanar connection in a single plane, but the connection may be non-coplanar as well. The ability to interconnect the stripline conductors may be implemented in a wide variety of approaches, and examples are shown in FIGS. 6 and 7.

Figure 6:
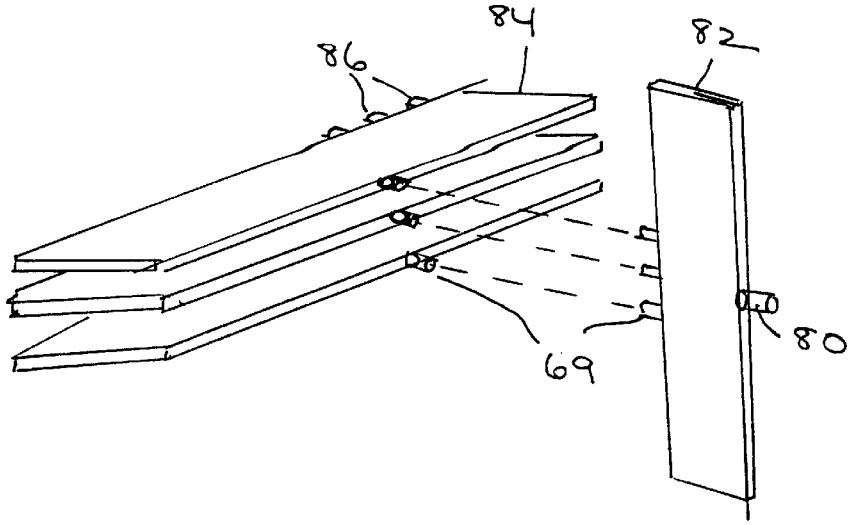
FIG. 6 is a schematic exploded perspective view of a single channel signal distribution system.

The embodiment of FIG. 6 illustrates the interconnection of a single first signal feed 80 with a vertical distribution board 82 and thence with horizontal distribution boards 84, and thence into a large number of second signal feeds 86. The distribution boards 82 and 84 are structured in the manner illustrated in FIG. 4. In all cases, the interconnections may be accomplished by the use of the interconnect structure 69 such as shown in FIG. 5. This embodiment of FIG. 6 achieves combination or division of a microwave signal in a single channel (i.e., a single feed 80 and multiple feeds 86). The energy flow may be from feed 80 to feeds 86, resulting in signal division, or from feeds 86 to feed 80, resulting in signal combination. The drawing illustrates three horizontal distribution boards, but there may be many more horizontal distribution boards as required for specific applications. In an application of interest to the inventors, there is the single first signal feed 80 and 48 horizontal distribution boards 84, and each of the horizontal distribution boards 84 has 48 second signal feeds 86. The device thus accomplishes either 2304-way combination or 2304-way division of microwave signals in a square aperture application, or approximately 1750-way combination or 1750-way division in a circular aperture application.

Figure 7:
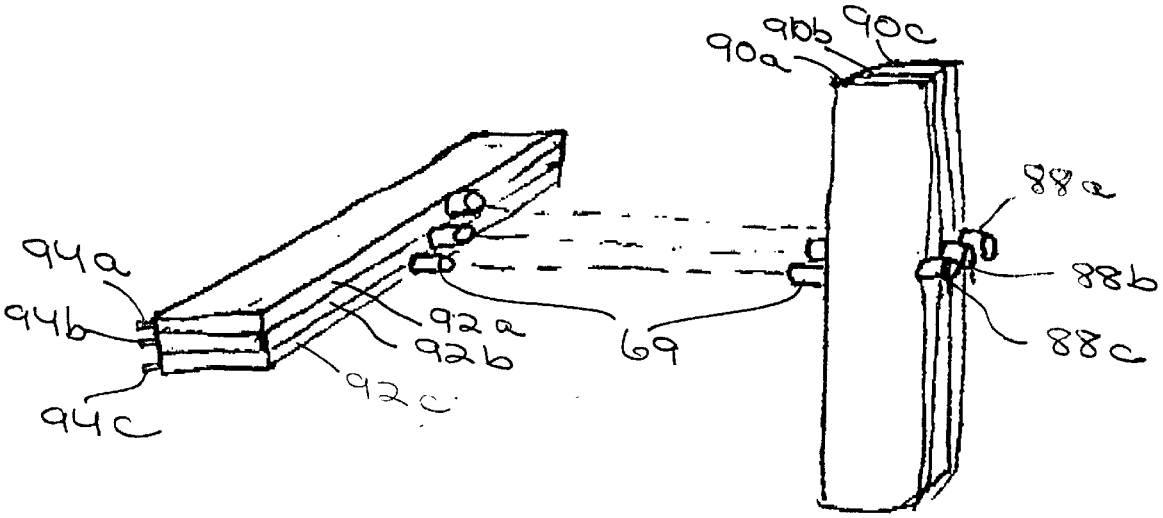
FIG. 7 is a schematic exploded perspective view of a multiple (in this case, three) channel signal distribution system.

The embodiment of FIG. 7 illustrates the interconnection of multiple independent channels, here first signal feeds 88*a*, 88*b*, and 88*c*, with respective vertical distribution boards 90*a*, 90*b*, and 90*c*, thence with multiple horizontal distribution boards 92*a*, 92*b*, and 92*c* and thence into a large number of second signal feeds 94*a*, 94*b*, and 94*c* communicating with the same output horn. This embodiment of FIG. 7 achieves combination or division of microwave signals in multiple (here, three) channels. That is, there are three independent communication paths (i.e., channels) between the feeds 88*a*, 88*b*, and 88*c* and all of the feeds 94*a*, 94*b*, and 94*c* that feed the output horn. In all cases, the interconnections may be accomplished by the use of the interconnect structure 69 such as shown in FIG. 5. The drawing illustrates only three independent first signal feeds 88*a*, 88*b*, and 88*c* and three horizontal distribution boards 92*a*, 92*b*, and 92*c*, but there may be many more first signal feeds and horizontal distribution boards as required for specific applications, limited only by the space available for the output horn aperture dimensions.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A microwave stripline structure including a first-layer conductor structure comprising:

a nonmetallic central conductor substrate having a first side and a second side, wherein the central conductor substrate comprises a composite material of quartz fibers embedded in a cured cyanate ester resin;

a first ground plane layer spaced apart from the first side of the central conductor substrate, the first ground plane layer including a first ground plane substrate, wherein the first ground plane substrate comprises a layer of semi-conductive, absorptive fibers, and a first metallic layer structure contacting at least one side of the first ground plane substrate;

a first foam layer disposed in contact with the first side of the central conductor substrate and with the first ground plane layer;

a second ground plane layer spaced apart from the second side of the central conductor substrate, the second ground plane layer including a second ground plane substrate, wherein the second ground plane substrate comprises a layer of semi-conductive, absorptive fibers, and a second metallic layer structure contacting at least one side of the second ground plane substrate;

a second foam layer disposed in contact with the second side of the central conductor substrate and with the second ground plane layer; and an elongated metallic central conductor on the first side of the central conductor substrate.

2. The stripline structure of claim 1, wherein the first foam layer has a first channel therethrough, and wherein the first foam layer, the central conductor substrate, and the first ground plane layer bound the first channel and the elongated metallic central conductor is within the first channel.

3. The stripline structure of claim 2, wherein the second foam layer has a second channel therethrough in registry with the first channel, and wherein the second foam layer, the central conductor substrate, and the second ground plane layer bound the second channel.

4. The stripline structure of claim 1, further including an interconnect to the metallic central conductor comprising a cylindrical extension at an end of the metallic central conductor.

5. The stripline structure of claim 1, further including a second-layer conductor structure in facing relation to the first-layer conductor structure, the second-layer conductor structure having the same structure as the first-layer conductor structure.

6. The stripline structure of claim 1, wherein the first foam layer and the second foam layer each comprise an electrically nonconductive, structural closed-cell foam.

7. The stripline structure of claim 1, further including a nonmetallic post extending through the central conductor substrate, the first ground plane layer, and the first foam layer.

8. The stripline structure of claim 1, wherein the central conductor substrate and the first ground plane layer are substantially planar and parallel to each other.

9. The stripline structure of claim 1, wherein the stripline structure contains no polytetrafluoroethylene.

10. A microwave stripline structure including a first-layer conductor structure comprising:

a substantially planar nonmetallic central conductor substrate having a first side and a second side;

a substantially planar first ground plane layer spaced apart from the first side of the central conductor substrate, the first ground plane layer including a first ground plane substrate comprising a layer of a nonmetallic material, and a first metallic layer structure on the first ground plane substrate, the first metallic layer structure including a first metallic inner layer facing the central conductor substrate and a first metallic outer layer disposed remotely from the central conductor substrate;

a substantially planar first foam layer in contact with the first side of the central conductor substrate and with the first ground plane layer, the first foam layer having a first channel therethrough, wherein the first foam layer, the central conductor substrate, and the first ground plane layer bound the first channel;

an elongated metallic central conductor on the first side of the central conductor substrate within the first channel;

a substantially planar second ground plane layer spaced apart from the second side of the central conductor substrate, the second ground plane layer including a second ground plane substrate comprising a second layer of a nonmetallic material, and a second metallic layer structure on the second ground plane substrate, the second metallic layer structure including a second metallic inner layer facing the central conductor substrate and a second metallic outer layer disposed remotely from the central conductor substrate; and a substantially planar second foam layer disposed in contact with the second side of the central conductor substrate and with the second ground plane layer, the second foam layer having a second channel therethrough in registry with the first channel, and wherein the second foam layer, the central conductor substrate, and the second ground plane layer bound the second channel.

11. The stripline structure of claim 10, further including an interconnect to the metallic central conductor comprising a cylindrical extension at an end of the metallic central conductor.

12. The stripline structure of claim 10, further including a second-layer conductor structure in facing relation to the first-layer conductor structure, the second-layer conductor structure having the same structure as the first-layer conductor structure.

13. The stripline structure of claim 10, wherein the first ground plane substrate and the second ground plane substrate each comprises a layer of semiconductive, absorptive fibers.

14. The stripline structure of claim 10, further including a nonmetallic post extending through the central conductor substrate, the first ground plane layer, the first foam layer, the second ground plane layer, and the second foam layer.

15. The stripline structure of claim 10, wherein the stripline structure contains no polytetrafluoroethylene.

* * * * *